US008061805B2

(12) United States Patent
Suzuki et al.

(10) Patent No.: US 8,061,805 B2
(45) Date of Patent: Nov. 22, 2011

(54) INKJET RECORDING APPARATUS

(75) Inventors: Seiji Suzuki, Ebina (JP); Hiroyuki Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 821 days.

(21) Appl. No.: 11/734,439

(22) Filed: Apr. 12, 2007

(65) Prior Publication Data

US 2007/0263027 A1 Nov. 15, 2007

(30) Foreign Application Priority Data

May 11, 2006 (JP) ..... 2006-132414

(51) Int. Cl.
*B41J 2/165* (2006.01)
*B41J 29/13* (2006.01)

(52) U.S. Cl. ..... 347/36; 347/31; 347/108

(58) Field of Classification Search ..... 347/31, 347/35, 36, 108
See application file for complete search history.

(56) References Cited

U.S. PATENT DOCUMENTS 5,172,140 A 12/1992 Hirabayashi et al.
5,745,134 A 4/1998 Hirabayashi et al.
6,203,138 B1 3/2001 Hirabayashi et al.
6,337,354 B1 * 1/2002 Katsumata et al. ..... 521/52
2005/0062794 A1 * 3/2005 Kanamitsu et al. ..... 347/31
2006/0023050 A1 * 2/2006 Nishiberi et al. ..... 347/104

FOREIGN PATENT DOCUMENTS

JP 4-135865 5/1992
JP 09-085965 A 3/1997
JP 2003-080739 A 3/2003
JP 2005-035074 A 2/2005
JP 2005-053125 A 3/2005
JP 2005-297495 A 10/2005

* cited by examiner

*Primary Examiner* — Geoffrey Mruk
(74) *Attorney, Agent, or Firm* — Fitzpatrick, Cella, Harper & Scinto

(57) ABSTRACT

A first ink absorption member recovering the waste ink produced by the recovery operation of a record head is disposed on the top surface of the bottom surface portion of an inkjet recording apparatus. The top surface of the first ink absorption member is covered by a cover member, which is a member other than the member constituting the outer-casing portion of the apparatus and is installed in the bottom surface portion in the state of being detachably attached. At least a part of the first ink absorption member is made to be exchangeable by the attaching/the detaching of the cover member.

7 Claims, 11 Drawing Sheets

INKJET RECORDING APPARATUS

BACKGROUND OF THE INVENTION

1. Field of the Invention

The present invention relates to an inkjet recording apparatus performing recording by discharging ink from a record head to a record medium.

2. Description of the Related Art

A recording apparatus is used as a recording apparatus having the function of a printer, a copier, a facsimile machine or the like, an output equipment of a multifunction device including a computer, a word processor or the like, or an output equipment of a work station. This recording apparatus is adapted to record an image on a record medium such as paper or a plastic sheet based on image information. The recording apparatus can be classified to an inkjet type one, a wire dot type one, a thermal-transfer type one, a thermal type one and a laser beam type one based on the record system thereof. Moreover, the recording apparatus can be classified to a serial type one and a line type one based on the scanning system thereof. The serial type recoding apparatus records an image by combining the main scanning moving a record head along a record medium and the sub-scanning performing the paper-feeding of a record medium. The line type recording apparatus records an image only by the sub-scanning in the conveyance direction, with recording data by one line in a lump using a record head extending in the width direction of the record medium.

The inkjet type recording apparatus (inkjet recording apparatus) drives a plurality of minute discharge ports formed in a record head based on image information, to selectively discharge ink from each discharge port and record an image. Consequently, as time elapses, ink in the discharge ports may dry to thicken and cohere, and a defective discharge may be caused. Moreover, the degradation of recording quality may be caused by the defective discharge caused by the mixing of paper powder, bubbles and the like into the ink in the discharge ports. In order to eject and remove such cohered ink, bubbles and the like, which are the causes of such a defective discharge, together with ink, sucking recovery processing is performed. The sucking recovery processing is the processing for forcibly ejecting ink by applying negative pressure sucking force caused by a pump to the ink at each discharge port every elapse of a predetermined period of time. Moreover, recovery processing by the preliminary discharge of performing an ink discharge from the discharge ports at the time other than that of recording is also performed from the discharge ports.

The waste ink ejected by the recovery processing is led to a waste ink collecting unit such as a waste ink tank through an ink tube. Then, the led waste ink is held by an absorption member including a filled ink absorbent material loaded in the inside of the waste ink collecting unit. The collecting mechanism of waste ink in such an inkjet recording apparatus is disclosed in, for example, Japanese Patent Application Laid-Open No. H04-135865.

It is necessary for an inkjet recording apparatus to have the sufficiently large capacity of the absorption member in order to thoroughly collect the waste ink ejected in the recovery processing to hold the recovered waste ink. However, the simple enlargement of the capacity needs to secure the space for the sake of it, and results in the enlargement in size of the apparatus main body. On the other hand, in order to miniaturize the apparatus main body, it can be considered to make the capacity of the absorption member small and to exchange the absorption member when the waste ink quantity in the absorption member approaches the saturation thereof. However, because the absorption member is normally disposed at the lowermost part of the apparatus main body and various parts are provided around the absorption member, the disassembling operation of the recording apparatus becomes necessary for exchanging the absorption member, and the operation is troublesome and takes a lot of time. Furthermore, if a pigment ink is used as the recording ink, the pigment ink absorbed by the absorption member starts to cohere early because the pigment ink easily coheres as compared with a dye ink. Consequently, the pigment ink has the disadvantage that the ink becomes difficult to absorb in the surface layer nearby a pigment ink absorption part of the absorption member.

SUMMARY OF THE INVENTION

It is an object of the present invention to provide an inkjet recording apparatus capable of easily exchanging an absorption member for collecting the ink ejected from a record head 21 by recovery processing.

It is an another object of the present invention to provide an inkjet recording apparatus performing recording by discharging ink from a record head to a record medium, the apparatus provided with an ink absorption member disposed on a top surface of an apparatus bottom surface portion, the ink absorption member collecting waste ink produced by a recovery operation of the record head, and a cover member, which is a member different from a member constituting an outer-casing portion of the apparatus and is installed in the apparatus bottom surface portion to be detachably attached so as to cover the top surface of the absorption member, whereby the ink absorption member can be exchanged by attaching/detaching the cover member.

Further features of the present invention will become apparent from the following description of exemplary embodiment with reference to the attached drawings.

DESCRIPTION OF THE EXEMPLARY EMBODIMENTS

Figure 1:
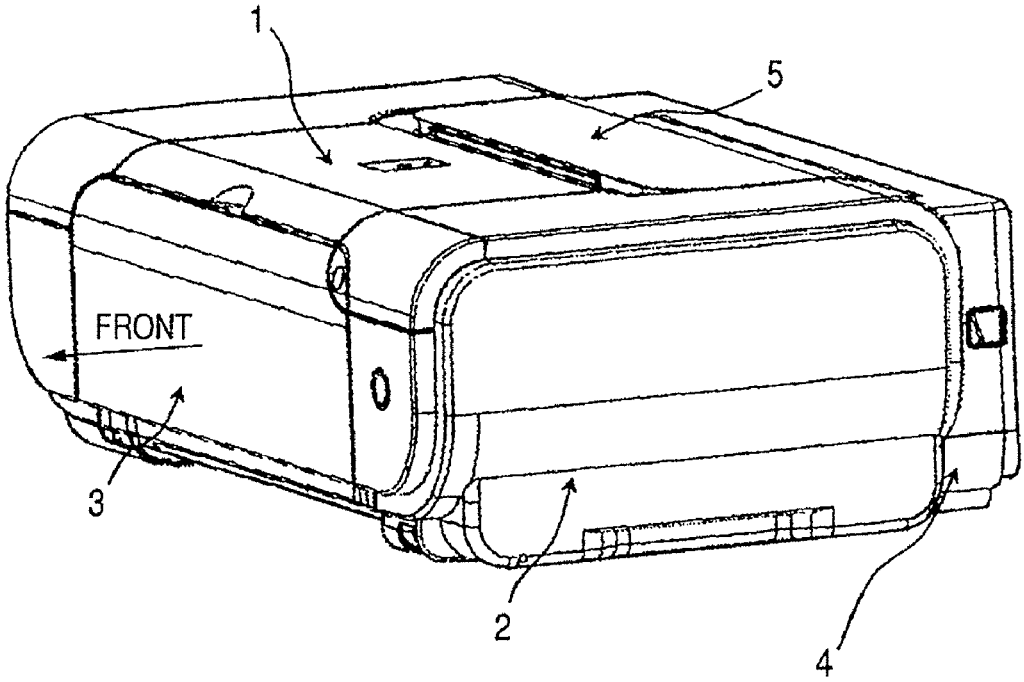
FIG. 1 is a perspective view illustrating the external appearance of an exemplary embodiment of the inkjet recording apparatus according to the present invention.
Figure 2:
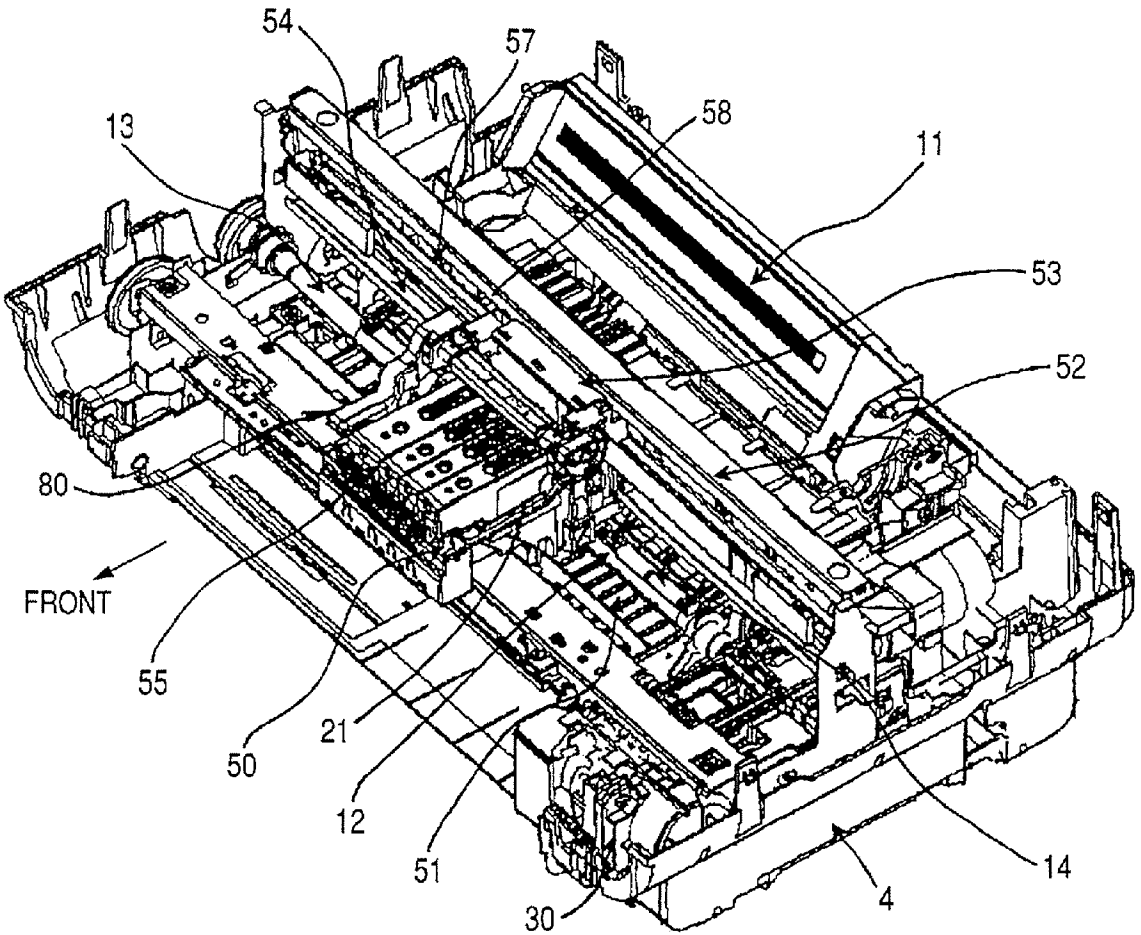
FIG. 2 is a perspective view illustrating the internal mechanism of the exemplary embodiment of the inkjet recording apparatus according to the present invention.
Figure 3:
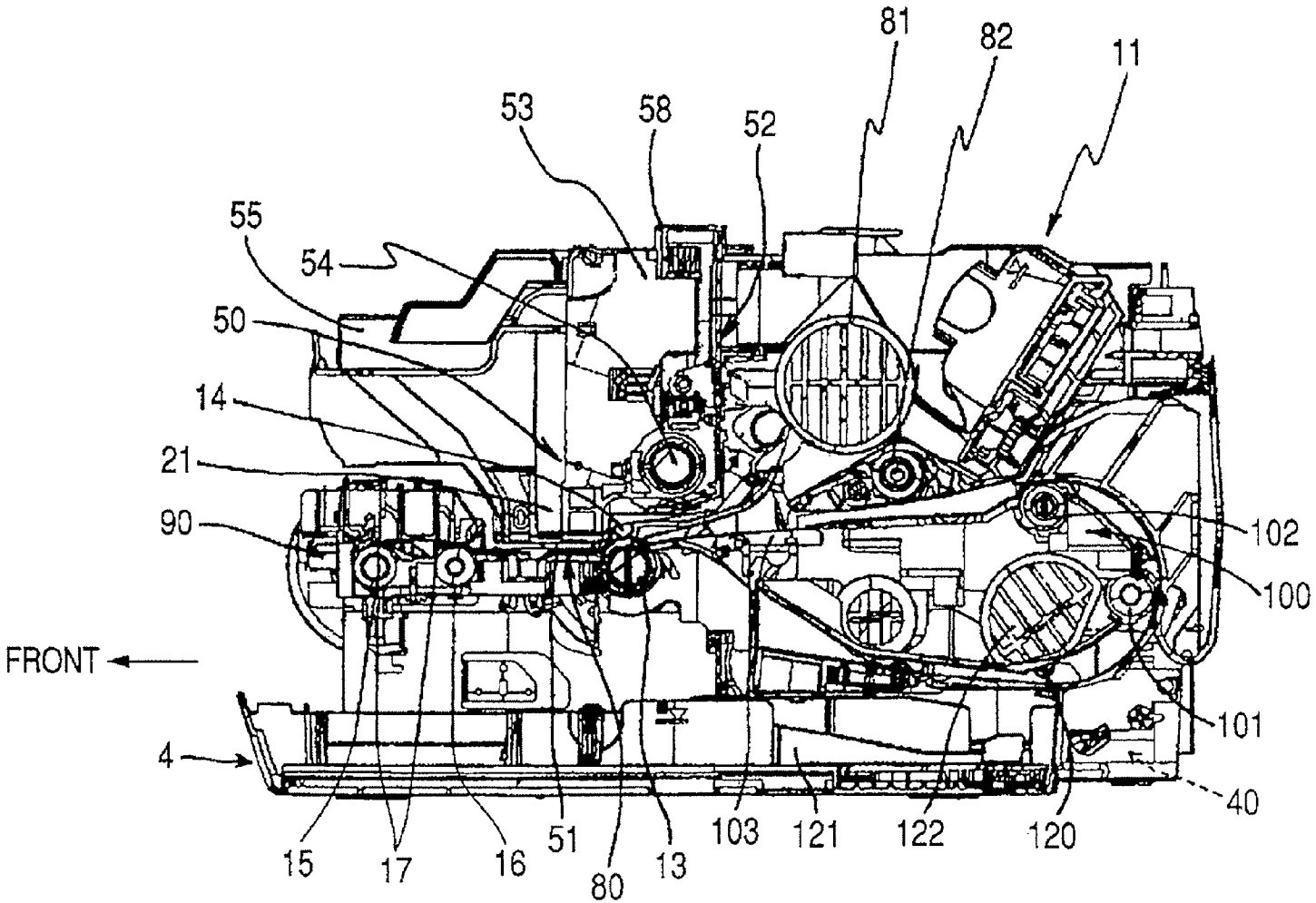
FIG. 3 is a longitudinal section of the inkjet recording apparatus of FIG. 2.

In the following, an exemplary embodiment of the present invention will be concretely described with reference to the attached drawings. Incidentally, the same reference marks severally denote the same or the corresponding components in all drawings. FIG. 1 is a perspective view illustrating the external appearance of an exemplary embodiment of the inkjet recording apparatus according to the present invention. FIG. 2 is a perspective view illustrating the internal mechanism of the exemplary embodiment of the inkjet recording apparatus according to the present invention. FIG. 3 is a longitudinal section of the inkjet recording apparatus of FIG. 2. In FIG. 1, the inkjet recording apparatus includes a main case 1, a side cover 2, a paper ejection tray 3, a base 4 and a paper feed tray 5. FIG. 1 illustrates the state in which the paper ejection tray 3 provided at the front portion of the apparatus is closed and the paper feed tray 5 provided at a position near the rear of the top surface of the apparatus is also closed. Moreover, the base 4 constitutes the bottom surface portion of the apparatus, and various mechanical sections are attached on the base as illustrated in FIGS. 2 and 3. Then, in the present exemplary embodiment, the main case 1, the side cover 2, the base 4 and the like constitute an outer-shell portion region of the apparatus.

In FIGS. 2 and 3, the inkjet recording apparatus is provided with a first paper feed unit 11 for feeding a record medium such as paper and a plastic sheet to a recording unit, and a conveyance unit 12 for conveying the fed record medium through a recording unit 80.

A record head 21 as a recording unit is mounted on a carriage 53. The carriage 53 is supported in the state of being guided to be able to reciprocate in the horizontal direction along a guide shaft 54 installed in the apparatus main body and a guide rail 58 formed in a chassis 52. The record head 21 discharges ink from a discharge port based on image information to record an image (including a character, a mark and the like) on a record medium. A recovery unit 30 for keeping and recovering the ink discharge performance of the record head 21 is provided at a position (ordinarily, home position) out of the recording area within the moving range of the carriage 53. Incidentally, a carriage unit (recording mechanical section) 50 includes the record head 21, ink tanks 55 and the like, each mounted on the carriage 53, and can reciprocate.

The record media loaded on the paper feed unit 11 is separated to be sent out one by one by a paper feed roller 81 driven by a paper feed motor, and is fed to the conveyance unit 12. A separation roller 82 is provided. The record medium sent into the conveyance unit 12 is conveyed through the recording unit 80 by the friction conveyance force caused by a conveyance roller 13 driven by a conveyance motor and a pinch roller 14 depressed by the conveyance roller 13. A platen 51 is provided at a position opposed to the record head 21 mounted in the carriage 53 with a predetermined space in the recording unit. An image is recorded on the record medium guided and supported on the top surface of the platen 51 by the record head 21. The recorded record medium is ejected to the outside of the apparatus main body by the conveyance force produced by paper eject rollers 15 and 16 driven in conjunction with the conveyance roller 13 and spurs 17 depressed by the respective paper eject rollers 15 and 16, and the ejected record medium is placed on the paper ejection tray 3.

In FIG. 3, the inkjet recording apparatus according to the present exemplary embodiment is provided with a U turn conveyance unit 100 and a second paper feed unit 120. The U turn conveyance unit 100 forms a conveyance path reversing the inside and the outside of a sent record medium. The second paper feed unit 120 is provided at a position near the rear of the apparatus. The record medium loaded on the paper feed tray 121 of the second paper feed unit 120 is fed to the U turn conveyance unit 100. After the record medium has been conveyed through the U turn conveyance unit 100 to be reversed, the recorded medium is sent into a nip section formed by the conveyance roller 13 and the pinch roller 14. Incidentally, when recording is performed on both the surfaces (the inside and the outside) of the record medium, the record medium having been subjected to recording on the inside by the recording unit 80 is sent into the U turn conveyance unit 100 by the reverse rotation driving of the conveyance roller 13.

In the second paper feed unit 120, the record media loaded on the paper feed tray 121 is separated one by one by a paper feed roller 122 and a separation roller (not shown) depressed by the paper feed roller 122, and is fed to the U turn conveyance unit 100. The record medium is conveyed by a first intermediate roller 101 and a second intermediate roller 102 provided at two points of the U turn conveyance path, and pinch rollers depressed by these intermediate rollers 101 and 102 with the front side and the back side of the record medium being reversed. A change-over flapper 103 is disposed at the junction of the conveyance path from the first paper feed unit 11 and the conveyance path from the U turn conveyance unit 100. The record medium conveyed by the U turn conveyance unit 100 with the inside and the outside thereof being reversed is sent into the nip section formed by the conveyance roller 13 and the pinch roller 14 through the change-over flapper 103. The processing after that is the same as that of the record medium fed from the first paper feed unit 11. That is, the record medium is conveyed by the conveyance unit 12; an image is recorded on the record medium by the recording unit 80; and the record medium is ejected onto the paper discharge tray 3 through a paper ejection unit 90 having the paper eject rollers 15 and 16.

Figure 4:
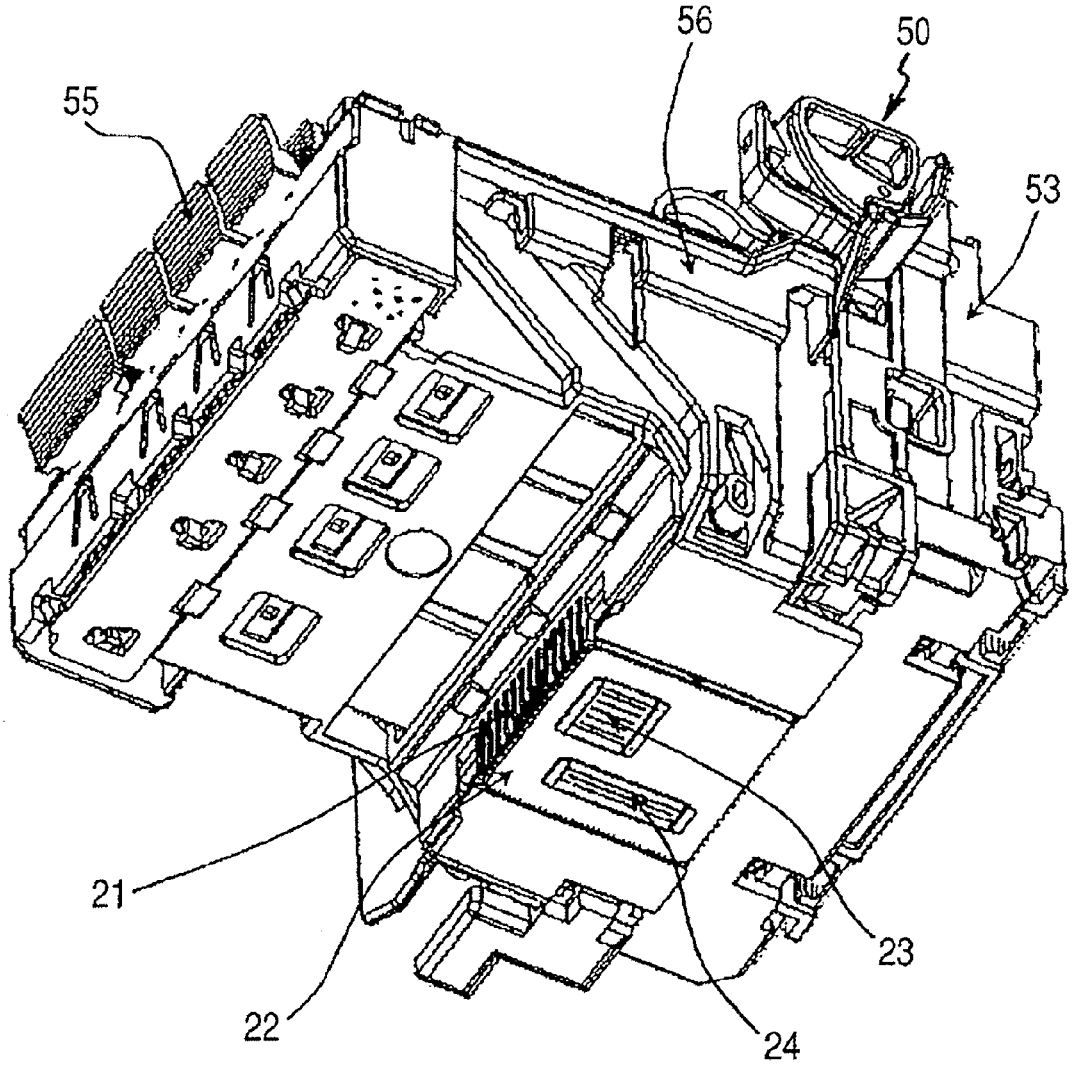
FIG. 4 is a perspective view of a carriage unit in FIG. 2 as viewed from the side of the bottom surface thereof.

FIG. 4 is a perspective view of the carriage unit 50 in FIG. 2 as viewed from the side of the bottom surface thereof. In FIGS. 2 to 4, the carriage 53 is mounted with the record head 21, and the ink tanks 55 are installed in the record head 21 in the state of being detachably attached. The carriage 53 can reciprocate along the guide shaft 54 and the guide rail 58, both of which are provided in parallel with each other on the chassis 52 constituting the apparatus main body. The carriage 53 is reciprocated by the drive force of a carriage motor, which drive force is transmitted through a carriage belt 57. An image is formed by synchronizing the drive of the record head 21 based on image information with the movement of the carriage 53 (main scanning). Then, the recording of the whole record medium is performed by the alternative repetition of the recording for one line and the conveyance of the record medium by a predetermined pitch.

As shown in FIG. 4, a discharge surface 22 is formed on the bottom surface portion of the record head 21. A color discharge port row 23 composed of a plurality of discharge ports discharging color ink and a black discharge port row 24 composed of a plurality of discharge ports discharging black ink are formed on the discharge surface 22 of the record head 21. The present exemplary embodiment uses the dye ink as the color ink and the pigment ink as the black ink. That is, the discharge port row 23 of three colors (for example, cyan, magenta and yellow) using three kinds of dye inks and the discharge port row 24 of black are arranged side by side on the discharge surface 22 of the record head 21. Moreover, a head cartridge composed of an ink discharge unit integrated with the ink tanks 55 may be used as the record head 21 in the present exemplary embodiment. Alternatively, an ink cartridge type one installing the ink tanks 55 in a built-in record head 21 (ink discharge unit) exchangeably may be used.

The present exemplary embodiment uses, for example, a thermal type record head 21 discharging ink using thermal energy as the record head 21. The record head 21 is provided with an electrothermal transducer for producing thermal energy at each discharge port. The record head 21 discharges ink from the discharge ports by causing film boiling in the ink in the discharge ports by the thermal energy applied to each electrothermaltransducer, and by using the changes of pressures owing to the growth and shrinks of the bubbles produced at the time. That is, the record head 21 selectively applies a pulse voltage according to a record signal to the electrothermal transducer provided to each of the plurality of discharge ports, and thereby records an image, discharging from a corresponding discharge port.

Figure 5:
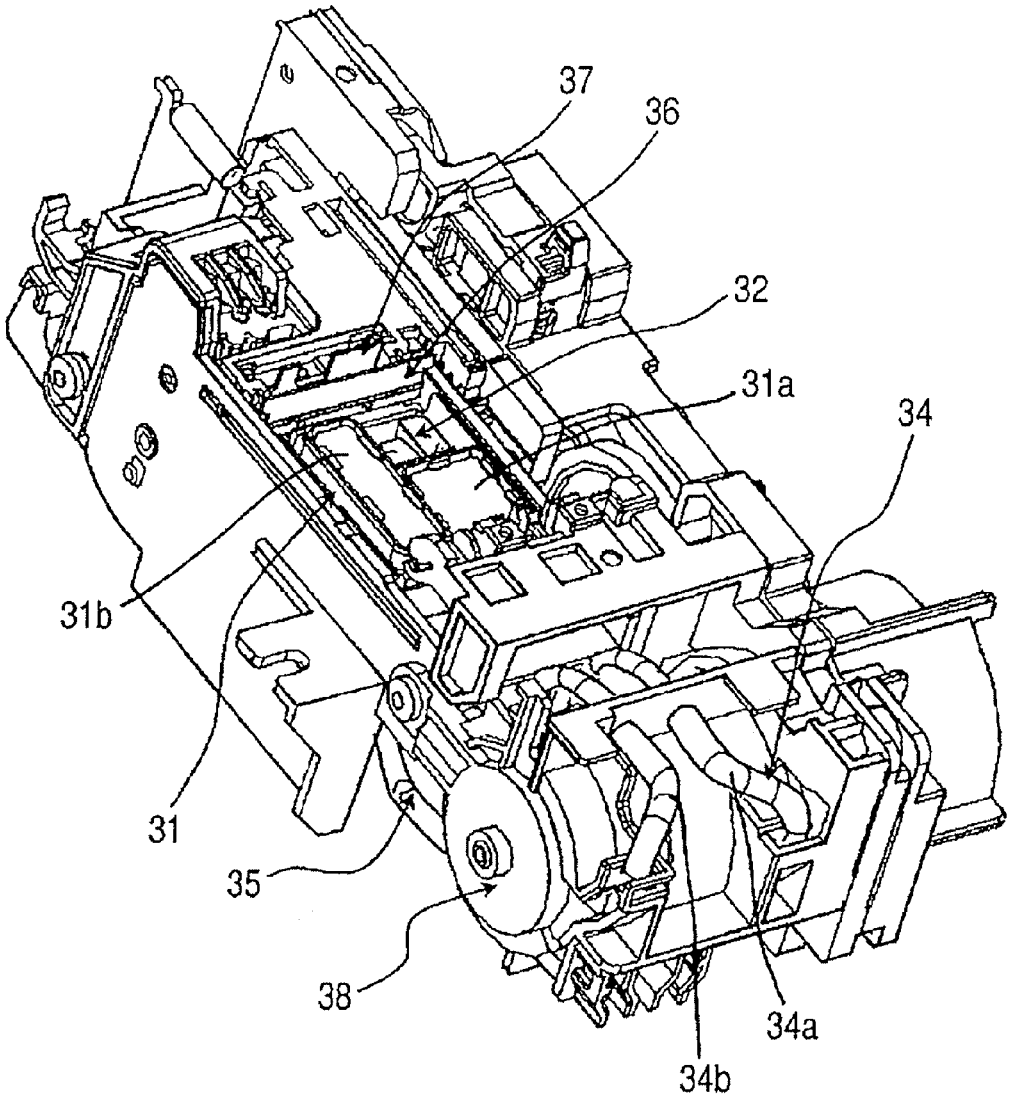
FIG. 5 is a perspective view of a recovery unit in FIG. 2.

FIG. 5 is a perspective view of the recovery unit 30 in FIG. 2. The recovery unit 30 is the one for keeping and recovering the ink discharge performance of the record head 21 to the normal state thereof by settling the clogging of the discharge ports thereof. In FIG. 5, the recovery unit 30 is provided with a capping unit, a suction unit and a wiping unit. The capping unit is provided with a cap 31 sealing up the discharge port by adhering closely to the discharge surface 22 of the record head 21, and a cap holder 32 mounted with the cap 31. The suction unit is provided with a suction pump 38 connected to the cap 31 through suction tubes 34. The wiping unit is provided with wipers 36 and 37 slidingly rubbing the discharge surface 22 to wipe the discharge surface 22 for cleaning.

In FIG. 5, the cap 31 of the present exemplary embodiment includes a color cap 31*a* for sealing up the color discharge port row 23 and a black cap 31*b* for sealing up the black discharge port row 24. Moreover, in the present exemplary embodiment, the color cap 31*a* and the black cap 31*b* are formed of two cap chambers created by the partition of the inside of the cap 31 into two sections. Incidentally, various cap configurations such as the structure being a common cap chamber without any partitions and the structure of dividing the cap into three sections or more can adopted in some arrangement configurations of the discharge port rows of the record head 21 or in some suction methods. The individual suction tubes 34*a* and 34*b* are connected to those caps 31*a* and 31*b*, respectively. Each of the suction tubes 34*a* and 34*b* are connected to the suction pump 38, which is a negative pressure producing unit.

In the case of performing a suction recovery operation, the suction pump 38 is operated in the state of sealing up the discharge ports with the cap 31 to suck the ink from the discharge ports, and thereby the ink is forcibly ejected. On the other hand, in the case of the recovery operation by a preliminary discharge, the ink is discharged from the record head 21 into the cap 31 in the state of separating the cap 31 from the discharge surface 22 to open the discharge port. Then, by operating the suction pump 38 in the state of opening the cap 31, the waste ink in the cap 31 is sucked. Consequently, at the time of sucking recovery processing, the discharge port row 23 of the color ink being the dye ink and the discharge port row 24 of the black ink being the pigment ink can be individually sucked. On the other hand, at the time of the recovery processing by the preliminary discharge, the dye ink discharged in the color cap 31*a* and the pigment ink discharged in the black cap 31*b* can be individually sucked.

Waste ink tubes 35 for leading (pumping) the waste ink into an absorption member 40 for collecting waste ink, which will be described later, are connected to the suction pump 38 on the ejection side thereof. The waste ink tubes 35 also include a tube 35*a* for color dye ink and a tube 35*b* for black pigment ink individually. In the present exemplary embodiment, a tube pump drawing (or squeezing) a tube to produce a negative pressure in the tube is used as the suction pump 38.

Figure 6:
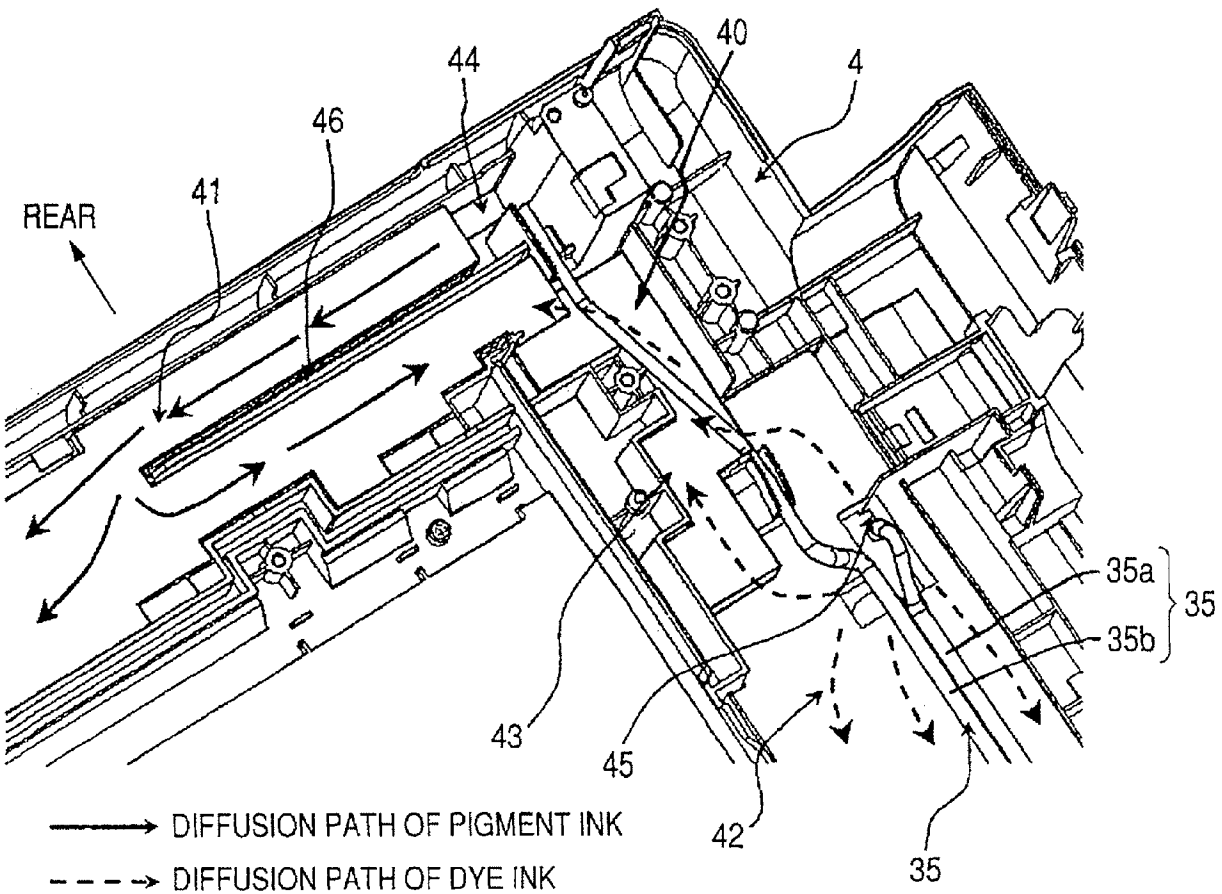
FIG. 6 is a perspective view illustrating the arrangement configuration of an absorption member arranged on the top surface of the bottom surface portion (base) of the inkjet recording apparatus illustrated in FIG. 2.

FIG. 6 is a perspective view illustrating the configuration of the absorption member 40 disposed on the top surface of the bottom surface portion (base) 4 of the inkjet recording apparatus illustrated in FIGS. 2 and 3. In FIG. 6, the ink absorption member 40 for collecting the waste ink produced by the recovery processing for keeping and recovering the ink discharge performance of the record head 21 is provided in the rear of the second paper feed unit 120 provided at a position near to the rear on the lowermost part of the recording apparatus. The ink absorption member 40 constituting the waste ink collecting portion is disposed on the top surface of the base 4 constituting the bottom surface portion of the recording apparatus. Moreover, the ink absorption member 40 of the present exemplary embodiment is adapted to couple three ink absorption members 41, 42 and 43. The first ink absorption member 41 is the absorption member in which a pigment ink is introduced, and an ejection port 44 of the waste ink tube 35*b* for black ink is connected to the first ink absorption member 41. The second ink absorption member 42 is the absorption member into which the dye ink is introduced, and an ejection port 45 of the waste ink tube 35*a* for color ink is connected to the second ink absorption member 42. Then, the first ink absorption member 41, into which the pigment ink is introduced, and the second ink absorption member 42, into which the dye ink is introduced, are coupled with each other by means of the third ink absorption member 43 as illustrated in the drawing, and then ink is let to be able to diffuse between them.

In the recording apparatus of the present exemplary embodiment, the second paper feed unit 120 is provided in a region near to the rear end of the apparatus main body. Moreover, the first ink absorption member 41 is disposed at a rear portion of the paper feed unit 120 on the top surface of the base 4 constituting the bottom surface portion of the apparatus as illustrated in FIGS. 7 to 11. Then, as it will be described later, only the first ink absorption member 41 is exchangeable. Moreover, a rib 46 for limiting the diffusion of the pigment ink into the first ink absorption member 41 to a predetermined direction is provided in the region in which the first ink absorption member 41 of the base 4 on which the absorption member 40 is disposed. The rib 46 is disposed so as to partition a part of the first ink absorption member 41 as illustrated in FIG. 6. In FIG. 6, the diffusion paths of the pigment ink are illustrated by solid line arrows and the diffusion paths of the dye ink are illustrated by dashed line arrows in the first ink absorption member 41.

In FIGS. 5 and 6, in the sucking recovery processing by the recovery unit 30 or in the recovery processing by the preliminary discharge, the dye ink and the pigment ink are ejected from the color discharge port row 23 and the black discharge port row 24 of the record head 21. The ejected waste ink is sucked by the suction pump 38, and is ejected to the absorption member 40 through the respective waste ink tubes 35*a* and 35*b*. Then, the dye ink is introduced from the ejection port 45 to the second ink absorption member 42, and the pigment ink is introduced from the ejection port 44 to the first ink absorption member 41. Then, the dye ink and the pigment ink perform diffusion permeation of the insides of the ink absorption members 42 and 41, respectively, and then are gradually mixed through the coupling absorption member 43. The mixing is performed through the diffusion paths as illustrated in FIG. 6 by the solid line arrows and the dashed line arrows.

In this case, because the pigment ink easily coheres and is deposited as compared with the dye ink, a part of the introduced pigment ink becomes a thicken ink to be deposited all around the vicinity of the first ink absorption member 41 in the vicinity of the ejection port 44 of the waste ink tube 35*b*. Moreover, another part of the introduced pigment ink coheres to start to be deposited at the part where the ink is absorbed after having been absorbed by the first ink absorption member 41, and the ink becomes difficult to diffuse and permeate at the surface layer in the vicinity of the part. In order to keep the diffusion permeability and the absorption performance of the ink of the first ink absorption member 41 at a level above a certain level, it is necessary to make the first ink absorption member 41 exchangeable.

Figure 7:
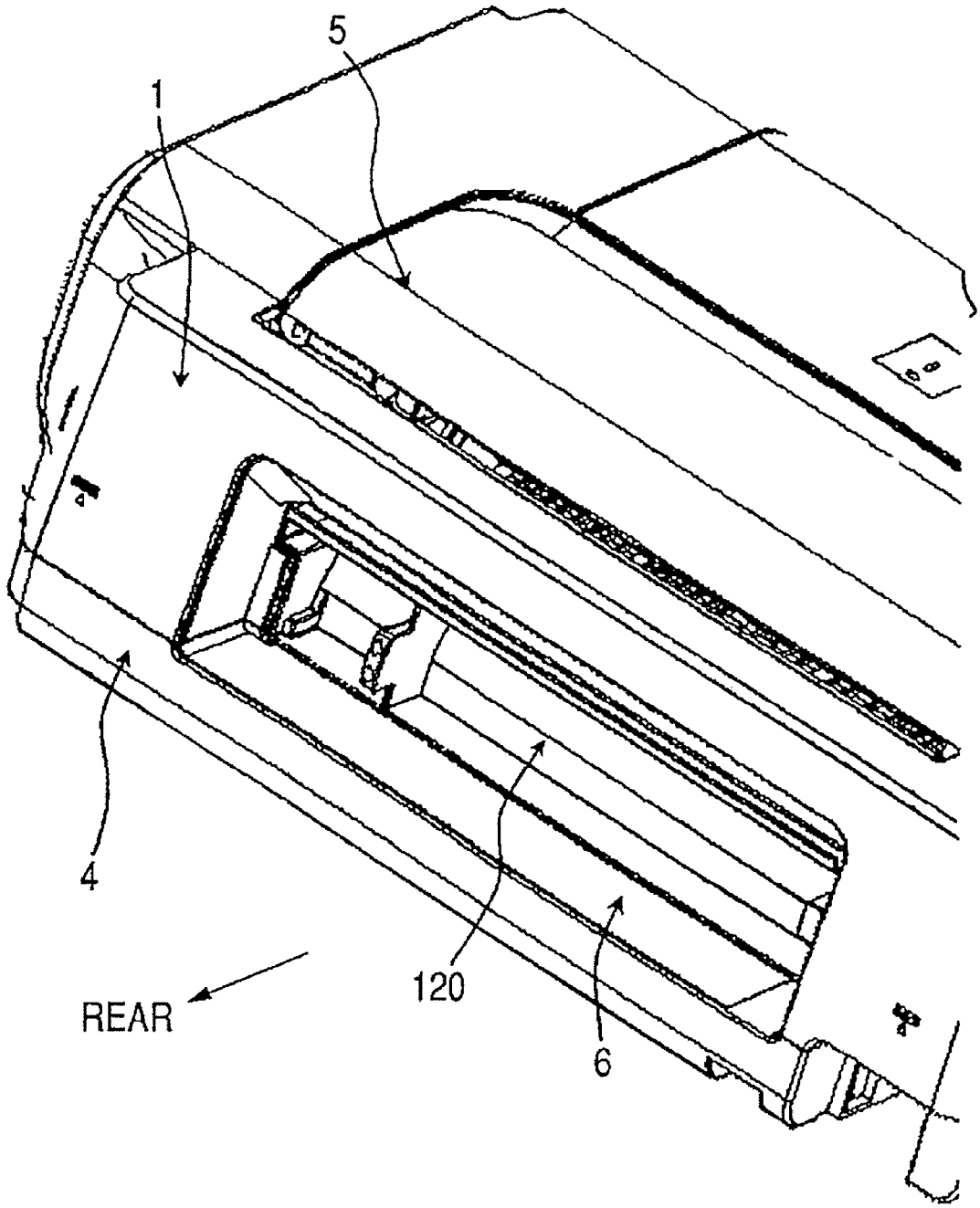
FIG. 7 is a perspective view illustrating the state of installing of a cover member for covering an exchangeable absorption member in the exemplary embodiment of the inkjet recording apparatus of the present invention.
Figure 8:
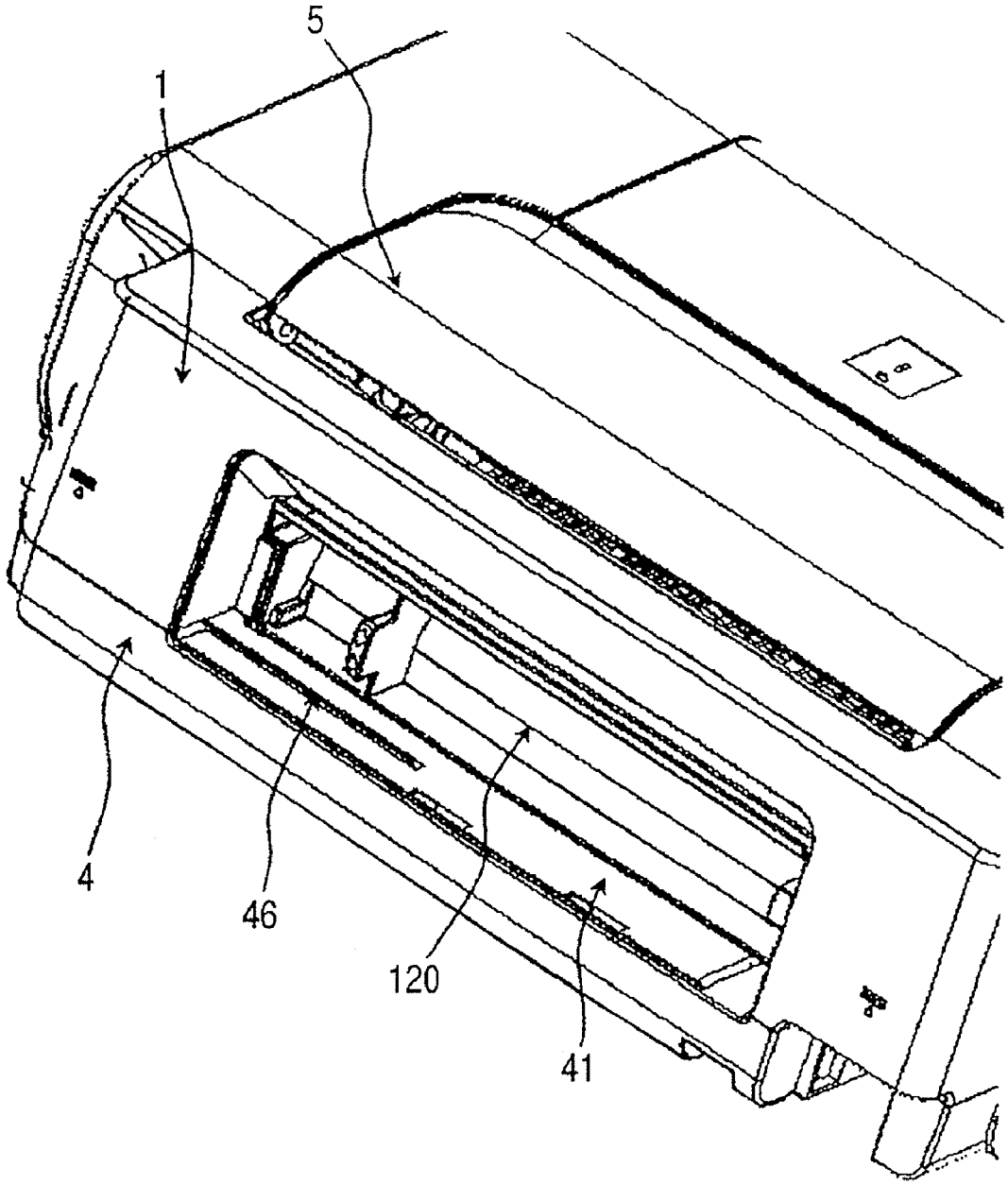
FIG. 8 is a perspective view illustrating the sate of enabling the absorption member to be exchangeable by taking off the cover member from the sate of FIG. 7.

FIG. 7 is a perspective view illustrating the state of installing the cover for covering the exchangeable ink absorption member in the exemplary embodiment of the inkjet recording apparatus of the present invention. FIG. 8 is a perspective view illustrating the state of making the ink absorption member exchangeable by taking off the cover from the state of FIG. 7.

Figure 9:
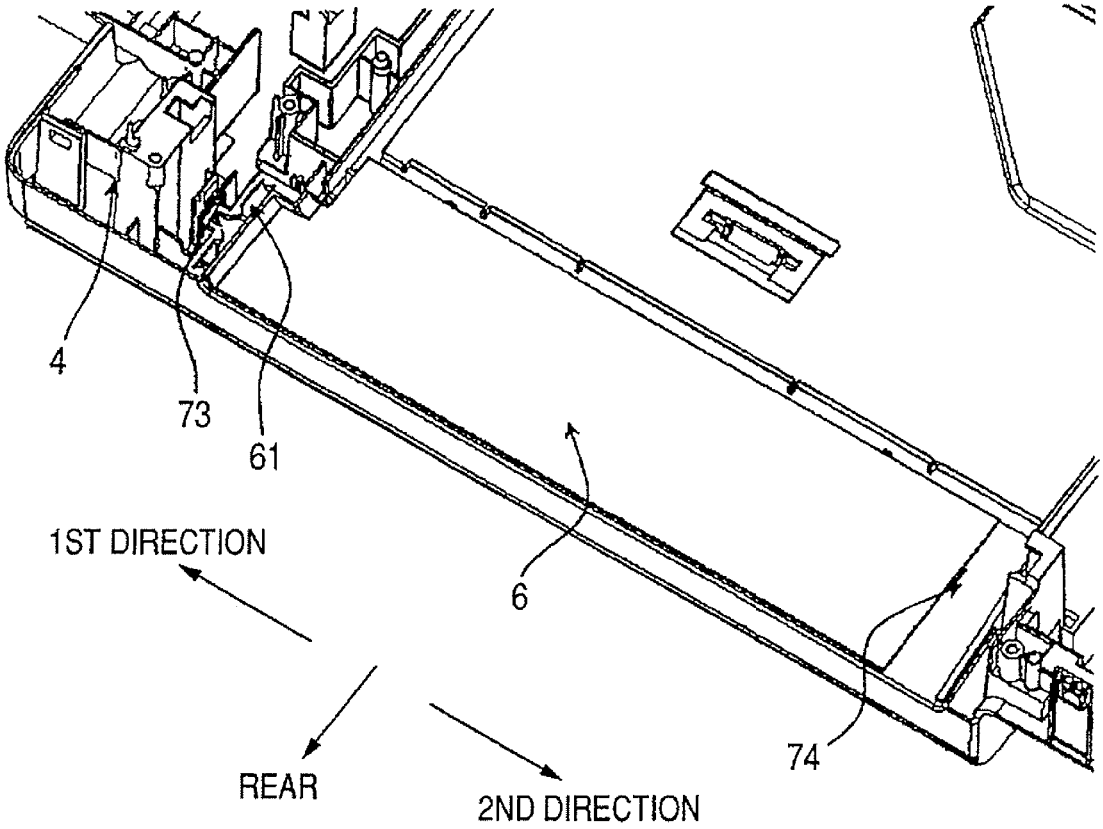
FIG. 9 is a perspective view illustrating the state of covering the absorption member with the cover member installed on the base in the exemplary embodiment of the inkjet recording apparatus according to the present invention.
Figure 10:
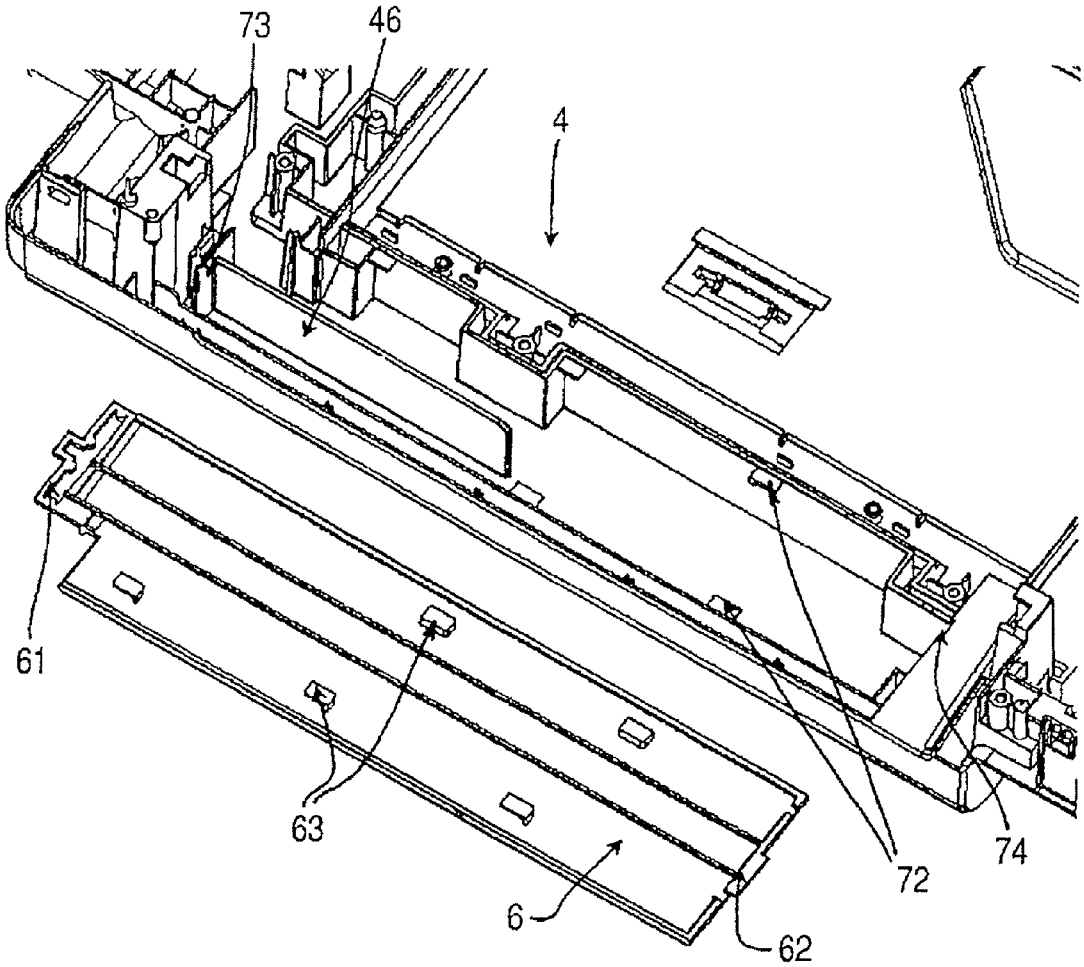
FIG. 10 is a perspective view illustrating the structure of the attachment portion of the cover member after taking off the cover member from the state of FIG. 9.
Figure 11:
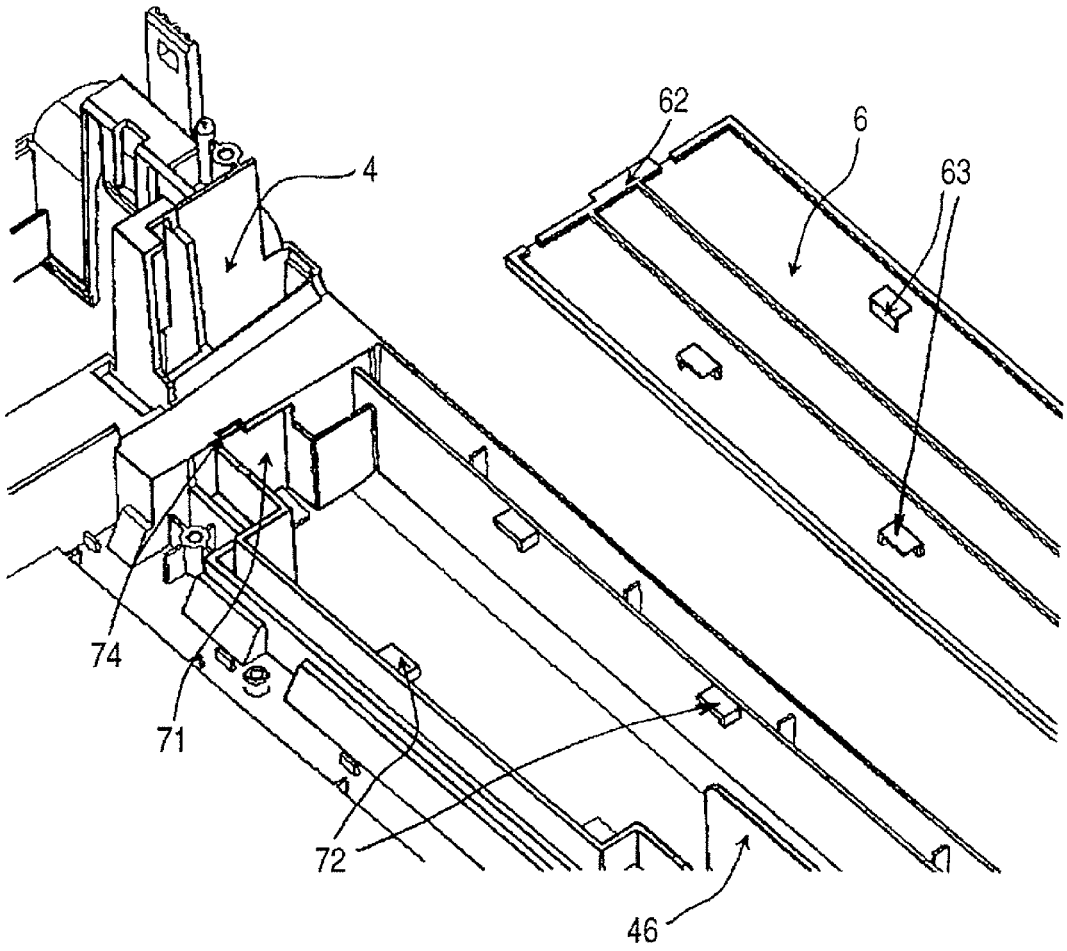
FIG. 11 is a partially enlarged perspective view illustrating the details of the attachment portion for installing the cover member in FIG. 10 onto the base.

FIG. 9 is a perspective view illustrating the state of covering the ink absorption member with the cover installed on the base in the exemplary embodiment of the inkjet recording apparatus according to the present invention. FIG. 10 is a perspective view illustrating the structure of the attachment portion of the cover by taking off the cover from the state of FIG. 9. FIG. 11 is a partially enlarged perspective view illustrating the details of the attachment portion for installing the cover of FIG. 10 on the base. In FIGS. 7 and 8, the first ink absorption member 41, into which the pigment ink is introduced through the waste ink tube 35*b*, is disposed in the rear of the second paper feed unit 120 on the top surface of the base 4 forming the bottom surface of the apparatus. A cover member 6 for covering the first ink absorption member 41 is attached to the base 4 in the state of being detachably attached. Then, the first ink absorption member 41 can be exchanged by taking off only the cover member 6. Moreover, a user can easily perform the attaching/the detaching (take off and attachment) of the cover member 6 by hand.

In FIGS. 7 to 11, hook portions 63 are formed at a plurality of positions on the back surface of the cover member 6, and hook portions 72 corresponding to the hook portions 63 are formed in the base 4. When the cover 6 is attached, each of the hook portions 63 is aligned to each of the hook portions 72, after that the cover 6 is slid to a first direction in FIG. 9, and thereby the hooks are mutually engaged. At this time, the cover member 6 is made to slide into the first direction until the striking (or abutment) portion 61 of the cover member 6 strikes (or abuts against) the striking surface 73 of the base 4. Incidentally, the striking portion 61 of the cover 6 is structured so as to be elastically deformed when force is applied to the striking portion 61 in the state of striking the striking surface 73 of the base 4. Consequently, by pushing in the cover 6, all of the hook portions 63 of the cover 6 can be mutually latched to all of the hook portions 72 of the base 4. Then, when the cover 6 is made to slide into the reverse direction (a second direction in FIG. 9) by the elastic restoring force of the striking portion 61 in the state in which the corresponding hook portions 63 and 72 are mutually latched, the projecting portion 62 on the end on the opposite side of the cover 6 is pressed down by an attachment portion 71 (FIG. 11) of the base 4. Thereby, the cover 6 is attached to the predetermined position of the base 4, and the first ink absorption member 41 is covered by the cover 6.

When the cover 6 is taken off from the base 4, notch portions 74 formed in the base 4 is utilized. That is, by making the cover 6 to slide by a certain quantity into the first direction in FIG. 9 and by depressing the striking portion 61 of the cover 6 while the striking portion 61 is struck against the striking surface 73 of the base 4, the striking portion 61 is elastically deformed. Then, the projecting portion 62 on the opposite side is taken off from the attachment portion 71. In this state, the projecting portion 62 is lifted, and the cover 6 is made to slide into the second direction in FIG. 9. Thereby, each of the hook portions 63 is taken off from each of the hook portions 72. Thus, the cover 6 can be taken off from the base 4. By taking off only the cover 6 in such a way, the exchange of the absorption member 41 can be easily performed.

According to the exemplary embodiment mentioned above, the top surface of the absorption member 41 is covered by the cover 6, which is a member different from the member constituting an outer-casing portion of the apparatus and is installed on the bottom surface portion (base 4) of the apparatus in the state of being detachably attached. Then, the first ink absorption member 41 of the absorption member 40 for collecting the waste ink is made to be exchangeable by the attaching/the detaching of the cover member 6. Consequently, the first ink absorption member 41 for collecting the ink (especially the pigment ink) ejected from the record head 21 can be easily exchanged by the recovery processing with simple and small-sized configuration. For example, when the cover 6 is attached and detached to and from the base 4, it is possible to eliminate the use of the troublesome and time-consuming operations such the operations of taking off the members constituting the outer-casing portion such as a main case 1 or the like or the operations performed by inverting the whole recording apparatus.

Moreover, according to the exemplary embodiment mentioned above, the cover 6 does not need any fastening unit such as screws, and a user can simply and easily attach and take off the cover 6 with his or her hand. Moreover, after exchanging the first ink absorption member 41, the waste ink absorbed and held by the other ink absorption members 42 and 43 can be made to be diffused and permeated to a new first ink absorption member 41 after the exchange. That is, the waste ink absorbed and held by the second ink absorption member 42 and the third ink absorption member 43, each being not exchanged, can be diffused and permeated to the inside of the first ink absorption member 41 after the exchange. Consequently, even if only the first ink absorption member 41 for pigment ink is exchanged, the waste ink ejected from the record head 21 can be successively absorbed and held, and a waste ink collecting function can be kept.

Moreover, the present exemplary embodiment is provided with an ejected ink counter counting the quantity of the waste ink produced by the recovery operation, and is provided with a reset control mechanism resetting the ejected ink counter according to the capacity of the first ink absorption member 41 to be exchanged. That is, the exchange of the first ink absorption member 41 is performed when the value of the ejected ink counter of the recording apparatus reaches a threshold value. This may be similarly applied to the exchanges of the other ink absorption members 42 and 43.

Incidentally, in the present exemplary embodiment, the case of using the shape structure of the base 4 of the apparatus as the shape and the fixing method of the cover member 6 has been described. However, the present invention is not limited to the exemplary embodiment, but the other configurations can be similarly implemented as long as the configuration can detachably attach only the cover member 6 without using any fastening units such as screws. Moreover, also the shape and the arrangement of the rib 46 of the base 4 are not limited to the exemplary embodiment, but the other shapes and arrangements may be adopted to some combinations of the inks to be used.

Incidentally, in the exemplary embodiment mentioned above, the serial type inkjet recording apparatus performing recording with the record head mounted on a carriage moving along a record medium has been exemplified and described. The present invention can be similarly applied to the line type inkjet recording apparatus performing recording only by the sub scanning using the recording head for full-line recording, and similar advantages can be obtained. Moreover, the present invention can be applied to the apparatus as long as the apparatus is the inkjet recording apparatus independent of the number of the record heads and the kinds and the properties of the ink to be used, and similar advantages can be obtained. Furthermore, the present invention is not limited to the single-body apparatus such as a recorder, a copier, a facsimile, a picked-up image formation apparatus and the like. That is, the present invention can be widely applied to the recording apparatus in a combined apparatus combining these single-body apparatuses or a combined apparatus such as a computer system, and similar advantages can be obtained.

According to the exemplary embodiment of the present invention, an inkjet recording apparatus capable of exchanging the absorption member for collecting the ink ejected from the recording head by the recovery processing with simple and small-sized configuration is provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-132414, filed May 11, 2006, which is hereby incorporated by reference herein in its entirety.

What is claimed is:

1. An inkjet recording apparatus performing recording by discharging ink from a record head to a recording medium, comprising:

a recording unit performing recording on the recording medium by the record head;

a paper feed unit feeding the recording medium loaded on a lower part of the apparatus to the recording unit, with a front side and a back side of the recording medium being reversed at the rear of the recording unit;

a casing, said casing including an upper case and a base;

an ink absorption member disposed on a top surface of the base, the ink absorption member collecting waste ink produced by recovery operation of the record head; and a cover member covering a part of the ink absorption member, the cover member being detachably attached to the base, arranged at the rear of the paper feed unit, and attachable to and detachable from the base in the rear of the recording apparatus.

2. The inkjet recording apparatus according to claim 1, wherein the absorption member is arranged to combine a plurality of ink absorption members.

3. The inkjet recording apparatus according to claim 1, further comprising:

a counter that counts a quantity of the waste ink produced by the recovery operation; and a control mechanism that resets the counter according to the capacity of the ink absorption member to be exchanged.

4. The inkjet recording apparatus according to claim 1, wherein the inks to be used for recording are a pigment ink and a dye ink, and wherein the inkjet recording apparatus is adapted to introduce each of the pigment ink and the dye ink, each ejected from the record head by the recovery operation, to the ink absorption member through respectively different paths, and to introduce the pigment ink to an exchangeable portion of the ink absorption member.

5. The inkjet recording apparatus according to claim 4, wherein the base is provided with a rib for limiting to a predetermined direction the diffusion of the pigment ink into the ink absorption member into a predetermined direction.

6. The inkjet recording apparatus according to claim 5, wherein the rib is provided in a region of the ink absorption member wherein the pigment ink is introduced to be diffused.

7. The inkjet recording apparatus according to claim 1, wherein the cover member is installed in the apparatus bottom surface portion by a means other than a screw.

* * * * *